US005957197A

United States Patent [19]

Xia et al.

[11] Patent Number: 5,957,197

[45] Date of Patent: Sep. 28, 1999

[54] DOWNHOLE CUT-OFF VALVE USED FOR CEMENTING

[75] Inventors: Xianchang Xia; Fuyan Zhang; Shaoxia Han; Xijun Tian; Hong Li, all of Panjin, China

[73] Assignee: Liaohe Petroleum Exploration Bureau of Xinglongtai, Panjin, China

[21] Appl. No.: 08/850,677

[22] Filed: May 2, 1997

[30] Foreign Application Priority Data

Apr. 10, 1997 [CN] China ..... 97 2 03159.6

[51] Int. Cl.[6] ..... E21B 33/13

[52] U.S. Cl. ..... 166/177.4; 137/68.17; 137/71; 137/517; 166/317; 166/319; 166/327

[58] Field of Search ..... 166/117.4, 317, 166/319, 327, 285; 137/68.17, 71, 517

[56] References Cited

U.S. PATENT DOCUMENTS

| | | | |
|---|---|---|---|
| 2,601,654 | 6/1952 | Wright | 137/517 |
| 3,013,612 | 12/1961 | Angel | 166/325 |
| 3,653,439 | 4/1972 | Kisling, III | 166/317 |
| 4,721,162 | 1/1988 | Pringle et al. | 166/319 |
| 4,955,949 | 9/1990 | Bailey et al. | 166/317 X |
| 5,348,089 | 9/1994 | Brandell et al. | 166/317 X |
| 5,609,178 | 3/1997 | Hennig et al. | 166/317 X |
| 5,692,476 | 12/1997 | Egler et al. | 137/517 X |
| 5,758,682 | 6/1998 | Cain | 137/71 X |

*Primary Examiner*—George Suchfield
*Attorney, Agent, or Firm*—Rothwell, Figg, Ernst & Kurz

[57] ABSTRACT

A downhole cut-off valve used for cementing a casing string, comprising: an outer hollow body, having a top end connected at the lower end of the casing string, an inner hole, an inner surface and a projecting shoulder forming on the inner surface and extending inwardly; an inner hollow body, arranged slidably in said outer hollow body and having an inner hole, a wall with a plurality of through holes and a projection forming on the wall and below the through holes and extending outwardly, the projection being adapted to fit with the projecting shoulder of said outer body to define a preliminary position of said inner body with respect to said outer body; the longitudinal positions of the through holes and the projection being arranged in such a manner that the projecting shoulder of said outer body is located therebetween when said inner body is placed in said outer body and will at least partially cover the through holes in response to the movement of said inner body; a relief member, blocking the upper end of the inner hole of said inner hollow body and releasing automatically to expose the upper end of the inner hollow body when necessary; an adjusting member, arranged in the lower portion of said outer hollow body and being able to move longitudinally, and; a resilient member, arranged between said outer hollow body and said inner hollow body and having one end against the projection of said inner body and another end against said adjusting member.

9 Claims, 1 Drawing Sheet

DOWNHOLE CUT-OFF VALVE USED FOR CEMENTING

The present invention relates to a downhole cut-off valve used for cementing during well completion.

BACKGROUND OF THE INVENTION

During a well cementing operation, after a casing string is set in a borehole, cement slurry needs to be pumped into the borehole in order to pack the layers of oil, gas and water and also to sustain the casings. Under the pressure from a pump, the pumped cement slurry flows upward to the annulus between the walls of the casings and the borehole after it reaches the bottom of the borehole through the casings.

However, in the course of a cementing operation in the above mentioned borehole, when the column height of the cement slurry inside the casing reaches a certain value, the difference in density between the fluids inside and outside of the casings will cause the cement slurry to move without the help of the pump pressure. Under such conditions, the pumped flow rate is unequal to the flow rate returning upward to the ground surface, which often results in occurrence of mud penetration and seriously deteriorated cementing quality.

In a conventional cementing operation, a ground pump flow recorder is often used to sense the flow rate of the pumped cement slurry in order to control the flow rate thereof, but the disadvantage of the prior art is that the flow rate of the cement slurry is not determined quickly enough at the moment of the cementing operation to compensate for unequal flow rates.

Therefore, the object of the invention is to overcome the disadvantage of the prior art. The invention provides a downhole cut-off valve which automatically can adjust the flow rate of a cement slurry in response to fluctuations in the difference between flow rates of pumped and return cement slurry.

SUMMARY OF THE INVENTION

According to the present invention, there is provided a downhole cut-off valve used for cementing a casing string within a bore hole, comprising:

- an outer hollow body, having a top end connected at the lower end of the casing string, an inner hole, an inner surface and a projecting shoulder formed on the inner surface and extending inwardly;
- an inner hollow body, arranged slidably in the outer hollow body and having an inner hole, a wall with a plurality of through holes and a projection formed on the wall and below the through holes and extending outwardly; the projection being adapted to fit with the projecting shoulder of the outer body to define a preliminary position of the inner body with respect to the outer body, the longitudinal positions of the through holes and the projection being arranged in such a manner that the projecting shoulder of the outer body will selectively at least partially cover the through holes in response to the movement of the inner body;
- a relief member, blocking up the upper end of the inner hole of the inner hollow body and releasing automatically when necessary;
- an adjusting member, arranged in the lower portion of the outer hollow body and being able to move longitudinally;
- an resilient member, arranged between the outer hollow body and the inner hollow body and having one end against the projection of the inner body and another end against the adjusting member.

Further objects and advantages of the invention will appear from the following description taken together with the accompanying drawings.

BRIEF DESCRIPTION OF THE ACCOMPANYING DRAWINGS

FIG. 1 is a sectional view showing a downhole cut-off valve according to the present invention.

DETAILED DESCRIPTION OF THE PREFERRED EMBODIMENT

Figure 1:
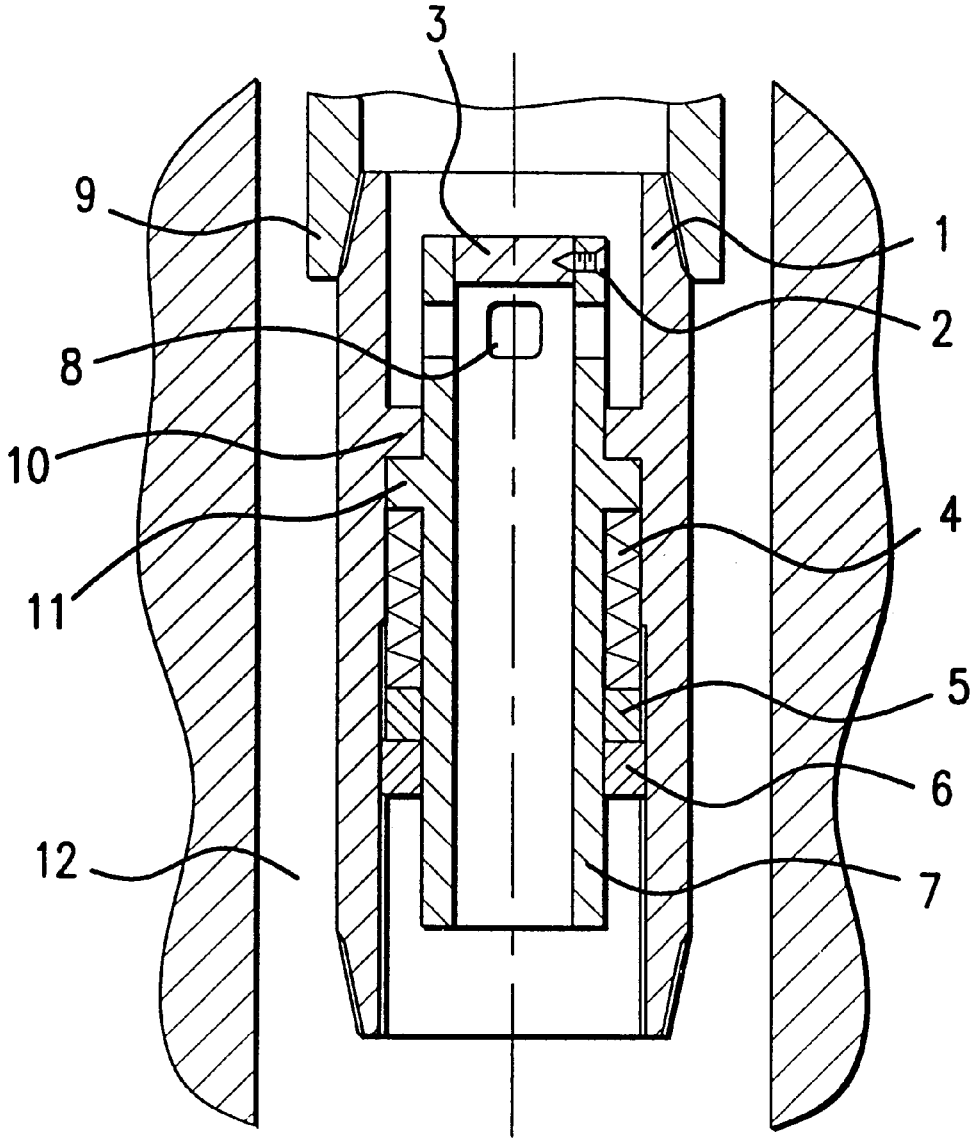

The downhole cut-off valve according to the present invention is used for cementing a casing string within a borehole, and comprises an outer hollow body 1. The outer body 1 has a top end connected at the lower end of the casing string 9, an inner hole, and a projecting shoulder 10 formed on the inner surface of body 1 and extending inwardly.

Preferably, the body 1 has the shape of a cylinder and the projecting shoulder 10 extends circumferentially around the entire inner surface of the cylinder.

An inner hollow body 7 is arranged slidably in the outer hollow body 1 and has a wall with a plurality of through holes 8. A projection 11 is formed on the outer surface of the wall and below the through holes 8, and extends outwardly. The projection 11 is used to fit with the projecting shoulder 10 of the outer body 1 to define a preliminary longitudinal position of the inner body 7 with respect to the outer body 1. The longitudinal positions of the holes 8 and the projection 11 are arranged in such a manner that the projecting shoulder 10 is located therebetween when the body 7 is placed in the body 1. In response to the movement of the inner body 7 within the outer body 1, the through-holes 8 may become covered by the projecting shoulder 10.

Preferably, the body 7 has the shape of a cylinder and the projection 11 extends circumferentially around the inner surface of body 7. Moreover, there are preferably provided four through-holes 8 arranged circumferentially on inner body 7 with a 90 degree separation between adjacent through-holes.

A relief member 3 is provided to cover the upper end of the inner hole of inner hollow body 7. A pin 2 is used to fix the member 3 in the inner hole of the body 7. The maximum compressive strength of pin 2 can be selected to have a value of 3 MPa.

An adjusting member 6 fits in the lower portion of the outer hollow body 1 and can move longitudinally within outer body 1 such as by being threaded within body 1.

A resilient member 4, for example a helical spring, is arranged between the outer hollow body 1 and the inner hollow body 7 and has one end against the projection 11 and another end against the adjusting member 6. The movement of the adjusting member 6 can thus bias the member 4 to obtain certain compressive energy.

A sealing washer 5 can be arranged between the member 4 and the adjusting member 6.

In practice, by a casing collar (not shown), the cut-off valve can be connected to the lower end of a casing string 9. Before the cut-off valve is sent into the borehole 12, the adjusting ring 6 needs to be moved longitudinally in order to give the spring 4 a desired compressive force. When the casings are set up in the borehole 12, the cementing operation begins and the pumped cement slurry flows from the interior of the casing through holes 8 into the inner hollow of the body 7, and then flows upward into the annulus between the walls of the borehole 12 and the body 1. During this process, the cut-off valve remains at its preliminary condition, that is the holes 8 are open completely. When the unequal flow rate condition mentioned above occurs, under the pressure resulting from the differential in fluid densities, the body 7 is forced to move gradually downward against the force of the spring 4 and the projection 11 disengages with the shoulder 10. With the movement of the body 7, the holes 8 move toward the shoulder 10 in such a manner that the holes 8 are blocked gradually by the shoulder 10. The reduced opening degree of the holes 8 leads to an increase of the pump pressure, and then the pump on the ground reduces its flow rate correspondingly to reduce the cement slurry flow rate into the annulus. After necessary measures are taken on the ground, the pumped rate is equal to the return rate again, the impact force applied by the liquid stream on the body 7 is reduced, and the spring 4 pushes the body 7 back to return to its preliminary position.

Moreover, under the condition that the holes 8 are blocked completely by the projecting shoulder 10 and that the inner casing pressure rises over 3 MPa, the pin 2 will be broken automatically so that the relief member 3 will fall through the inner hole of the body 7 downward into the downhole thereby allowing the cement slurry to flow into the annulus through the upper end of the body 7 to avoid danger in the cementing operation.

The advantage of the invention lies in that it can be used to avoid the penetration of impurities such as mud into the cement slurry in the course of the cementing operation so as to insure cementing quality. The device according to the invention has the features of small volume, light weight, simple structure and can be used conveniently and widely in various cementing operations.

While the description of the invention has been given with respect to a preferred embodiment, it shall not be construed in a limited sense. Variation and modification will occur to those skilled in the art. Reference is made to the appended claims for a definition of the invention.

We claim:

1. A downhole cut-off valve used for cementing a casing string within a borehole, comprising:

an outer hollow body, having a top end adapted to be connected to the lower end of the casing string, an inner surface, and a projecting shoulder formed on the inner surface and extending toward the interior of said outer hollow body;

an inner hollow body, slidably mounted in said outer hollow body, having a wall containing a plurality of through-holes and a projection formed thereon and extending outwardly from said wall, said projection abutting against said projection shoulder in a preliminary position of said inner hollow body with respect to said outer hollow body such that said through-holes are exposed to the interior of said outer hollow body, whereby a fluid pumped into said casing string enters said inner hollow body through said through-holes, said inner hollow body moving within said outer hollow body in response to a predetermined pressure exerted by said fluid such that said through-holes are at least partially covered by said projecting shoulder; and a resilient member coupled to said inner hollow body for exerting a force on said inner hollow body to return said inner hollow body to said preliminary position when the pressure from said fluid is less than said predetermined pressure.

2. A downhole cut-off valve as claimed in claim 1, further comprising a relief member blocking an aperture in the top of said inner hollow body, said relief member being automatically released to expose said aperture in response to a second predetermined pressure exerted by said fluid.

3. A downhole cut-off valve as claimed in claim 1, further comprising an adjusting member arranged in said outer hollow body and being adapted to adjust the force exerted by said resilient member on said inner hollow body.

4. A downhole cut-off valve used for cementing as claimed in claim 1 wherein both said outer hollow body and said inner hollow body have the shape of a cylinder.

5. A downhole cut-off valve used for cementing as claimed in claim 1 wherein both the projecting shoulder and the projection are circumferentially formed.

6. A downhole cut-off valve used for cementing as claimed in claim 3 wherein said adjusting member is threaded with the lower portion of said outer hollow body.

7. A downhole cut-off valve used for cementing as claimed in claim 2 wherein a pin is used to fix said relief member at the upper end of said inner hollow body and has a maximum compressive strength of 3 MPa.

8. A downhole cut-off valve used for cementing as claimed in claim 4, wherein the through-holes formed in the wall of said inner hollow body comprise at least four through-holes arranged circumferentially and separated from each other by an angle of 90 degrees.

9. A downhole cut-off valve used for cementing as claimed in claim 1 further comprises a casing collar to connect the valve to the lower end of the casing string.

* * * * *